US008896510B2

(12) United States Patent
Lee

(10) Patent No.: US 8,896,510 B2
(45) Date of Patent: Nov. 25, 2014

(54) DISPLAY DEVICE AND DRIVING METHOD THEREFOR

(75) Inventor: Baek-Woon Lee, Yongin-si (KR)

(73) Assignee: Samsung Display Co., Ltd. (KR)

( * ) Notice: Subject to any disclaimer, the term of this patent is extended or adjusted under 35 U.S.C. 154(b) by 1423 days.

(21) Appl. No.: 11/512,549

(22) Filed: Aug. 29, 2006

(65) Prior Publication Data

US 2007/0046609 A1 Mar. 1, 2007

(30) Foreign Application Priority Data

Aug. 29, 2005 (KR) ..... 10-2005-0079412

(51) Int. Cl.
*G09G 3/36* (2006.01)

(52) U.S. Cl.
CPC ..... *G09G 3/3648* (2013.01); *G09G 2310/0205* (2013.01); *G09G 2320/0285* (2013.01); *G09G 2320/0223* (2013.01); *G09G 2310/0251* (2013.01)
USPC ..... 345/89; 345/92; 345/96; 345/204

(58) Field of Classification Search
CPC ..... G09G 3/3692; G09G 2310/0251
USPC ..... 345/89, 92, 96, 204
See application file for complete search history.

(56) References Cited

U.S. PATENT DOCUMENTS

| | | | | |
|---|---|---|---|---|
| 6,021,221 | A | 2/2000 | Takaha | |
| 6,400,350 | B1 | 6/2002 | Nishimura et al. | |
| 6,583,778 | B1 | 6/2003 | Nishimura et al. | |
| 6,781,568 | B2 | 8/2004 | Nishimura et al. | |
| 6,940,481 | B2 * | 9/2005 | Konno et al. | 345/96 |
| 2002/0041267 | A1 * | 4/2002 | Jung | 345/92 |
| 2002/0047820 | A1 | 4/2002 | Ha | |
| 2002/0090110 | A1 * | 7/2002 | Braudaway et al. | 382/100 |

(Continued)

FOREIGN PATENT DOCUMENTS

| | | |
|---|---|---|
| CN | 1488978 | 4/2004 |
| EP | 1122711 A2 | 8/2001 |

(Continued)

OTHER PUBLICATIONS

Patent Abstracts of Japan, Publication No. 10-187936, Jul. 21, 1998, 1 p.

(Continued)

*Primary Examiner* — William Boddie
*Assistant Examiner* — Leonid Shapiro
(74) *Attorney, Agent, or Firm* — Innovation Counsel LLP

(57) ABSTRACT

A display device includes an image signal modifier for modifying input image signals based on the difference between the input image signal for a pixel in a first row and the input image signal for the pixel in the adjacent row. The gate-on voltages includes a pre-charging voltage and a main charging voltage, the main charging voltage for the first row overlaps the pre-charging voltage for the second row and the pre-charging voltage for the first grow overlaps the main charging voltage for the second row for a predetermined time. The first data voltage is applied to the pixels of the first and second rows after application of the main charging gate-on voltage for the first row and the pre-charging gate-on voltage for the row, and the second data voltage is applied to the pixel of the second row after application of the main charging gate-on voltage for the second row.

19 Claims, 8 Drawing Sheets

(56) References Cited

U.S. PATENT DOCUMENTS

| | | | | |
|---|---|---|---|---|
| 2003/0038766 | A1* | 2/2003 | Lee et al. | 345/87 |
| 2003/0080932 | A1 | 5/2003 | Konno et al. | |
| 2004/0012554 | A1 | 1/2004 | Song et al. | |
| 2004/0196238 | A1* | 10/2004 | Pfeiffer et al. | 345/89 |
| 2005/0057476 | A1* | 3/2005 | Lin et al. | 345/92 |

FOREIGN PATENT DOCUMENTS

| | | | |
|---|---|---|---|
| JP | 63-077031 | A | 4/1988 |
| JP | 02-123326 | A | 5/1990 |
| JP | 03-040674 | A | 2/1991 |
| JP | 10-187936 | | 7/1998 |
| JP | 11-202288 | | 7/1999 |
| JP | 2001-27887 | | 1/2001 |
| JP | 2001-356738 | | 12/2001 |
| JP | 2002-72250 | | 3/2002 |
| JP | 2002-335424 | | 11/2002 |
| JP | 2004-54295 | | 2/2004 |
| JP | 2004-061670 | A | 2/2004 |
| JP | 2004-199070 | | 7/2004 |
| JP | 2004-282593 | | 10/2004 |
| JP | 2005-020274 | | 1/2005 |
| JP | 2005-077550 | | 3/2005 |
| JP | 2005-134724 | A | 5/2005 |
| JP | 2005-140883 | A | 6/2005 |
| KR | 2003-010287 | | 2/2003 |
| KR | 2004-008919 | | 1/2004 |
| KR | 2004-016029 | | 2/2004 |
| KR | 2004-020318 | | 3/2004 |
| KR | 2004-038412 | | 5/2004 |
| KR | 2004-078536 | | 9/2004 |
| KR | 2004-105932 | | 12/2004 |
| KR | 2005-003813 | | 1/2005 |
| KR | 2005-004661 | | 1/2005 |
| KR | 2005-043414 | | 5/2005 |
| TW | 538397 | | 6/2003 |
| TW | I226949 | | 1/2005 |

OTHER PUBLICATIONS

Patent Abstracts of Japan, Publication No. 2001-027887, Jan. 30, 2001, 1 p.
Patent Abstracts of Japan, Publication No. 2002-072250, Mar. 12, 2002, 2 pp.
Patent Abstracts of Japan, Publication No. 2002-335424, Nov. 22, 2002, 1 p.
Patent Abstracts of Japan, Publication No. 2004-054295, Feb. 19, 2004, 1 p.
Patent Abstracts of Japan, Publication No. 2004-282593, Oct. 7, 2004, 1 p.
Patent Abstracts of Japan, Publication No. 2005-020274, Jan. 20, 2005, 1 p.
Patent Abstracts of Japan, Publication No. 2005-077550, Mar. 24, 2005, 1 p.
Korean Patent Abstracts, Publication No. 1020030010287, Feb. 5, 2003, 1 p.
Korean Patent Abstracts, Publication No. 1020040008919, Jan. 31, 2004, 1 p.
Korean Patent Abstracts, Publication No. 1020040016029, Feb. 21, 2004, 1 p.
Korean Patent Abstracts, Publication No. 1020040020318, Mar. 9, 2004, 1 p.
Korean Patent Abstracts, Publication No. 1020040038412, May 8, 2004, 1 p.
Korean Patent Abstracts, Publication No. 1020040078536 Sep. 10, 2004, 1 p.
Korean Patent Abstracts, Publication No. 1020040105932, Dec. 17, 2004, 1 p.
Korean Patent Abstracts, Publication No. 1020050003813, Jan. 12, 2005, 1 p.
Korean Patent Abstracts, Publication No. 1020050004661, Jan. 12, 2005, 1 p.
Korean Patent Abstracts, Publication No. 1020050043414, May 11, 2005, 1 p.

* cited by examiner

DISPLAY DEVICE AND DRIVING METHOD THEREFOR

CROSS-REFERENCE TO RELATED APPLICATION

The present application claims priority from Korean Patent Application No. 2005-0079412, filed on Aug. 29, 2005, the disclosure of which is hereby incorporated herein by reference in its entirety.

FIELD OF THE INVENTION

The present invention relates to a display device and a driving method therefor.

DESCRIPTION OF RELATED ART

Generally, a liquid crystal display (LCD) includes two panels provided with pixel electrodes and a common electrode (referred to as "filed generating electrodes"), and a liquid crystal (LC) layer with dielectric anisotropy interposed therebetween. The pixel electrodes are arranged in a matrix and are connected to switching elements such as thin film transistors (TFT) through a plurality of gate lines and a plurality of data lines which sequentially receive data signals on a row by row basis. The common electrode covers the entire surface of an upper panel of the two panels and is supplied with a common voltage. A pixel electrode, a common electrode, and the LC layer form an LC capacitor, and the LC capacitor together with a switching element connected thereto comprise a basic unit of a pixel. The LCD applies the voltages to the field generating electrodes to generate an electric field to the LC layer, and adjusts the transmittance of light passing through the LC layer by controlling the strength of the electric field to display desired images.

In order to prevent image deterioration due to long-term application of the unidirectional electric field, etc., the polarity of the data voltages with respect to the common voltage is reversed every frame, every row, or every pixel. LCDs that are used for television sets need to display images in motion. However, since the response time of the liquid crystal molecules in the LCDs is not particularly fast, it is hard to display moving images. Furthermore, LCDs retain images for some time, for example, one frame, resulting in blurring of a moving image. To compensate for this effect, pre-charging data voltages are applied to the LC capacitor before applying normal image data voltages so that the LC molecules are arranged in advance. The pre-charging decreases the difference between the applied voltage and the target voltage at the LC capacitor and therefore reduces the time for the voltage to reach the target value.

Although data voltages of equal magnitudes may be applied to the LC capacitors in the same pixel row, when the pre-charging voltages are different from each other a luminance difference occurs among the pixels resulting in superimposition of one image on another.

SUMMARY OF THE INVENTION

In accordance with the present invention, a modified image signal is based on the difference between the input image signal for a pixel in a first row and the input image signal for the pixel in the adjacent row. Image signals (referred to as "present image signals $d_q$") with respect to pixels PX of any one pixel row q are modified based on the image signals (referred to as "previous image signals $d_{q-1}$") with respect to pixels PX of a previous pixel row q−1, to generate modified image signals $d_q'$. The data driver changes the first input image signal and the modified image signal into first and second data voltages applied to the data line for the two rows. The gate-on voltages includes a pre-charging voltage and a main charging voltage, the main charging voltage for the first row overlaps the pre-charging voltage for the second row and the pre-charging voltage for the first grow overlaps the main charging voltage for the second row for a predetermined time. The first data voltage is applied to the pixels of the first and second rows after application of the main charging gate-on voltage for the first row and the pre-charging gate-on voltage for the row, and the second data voltage is applied to the pixel of the second row after application of the main charging gate-on voltage for the second row.

BRIEF DESCRIPTION OF THE DRAWING

The present invention will become more apparent from a reading of the ensuing description together with the drawing, in which.

DETAILED DESCRIPTION

Figure 1:
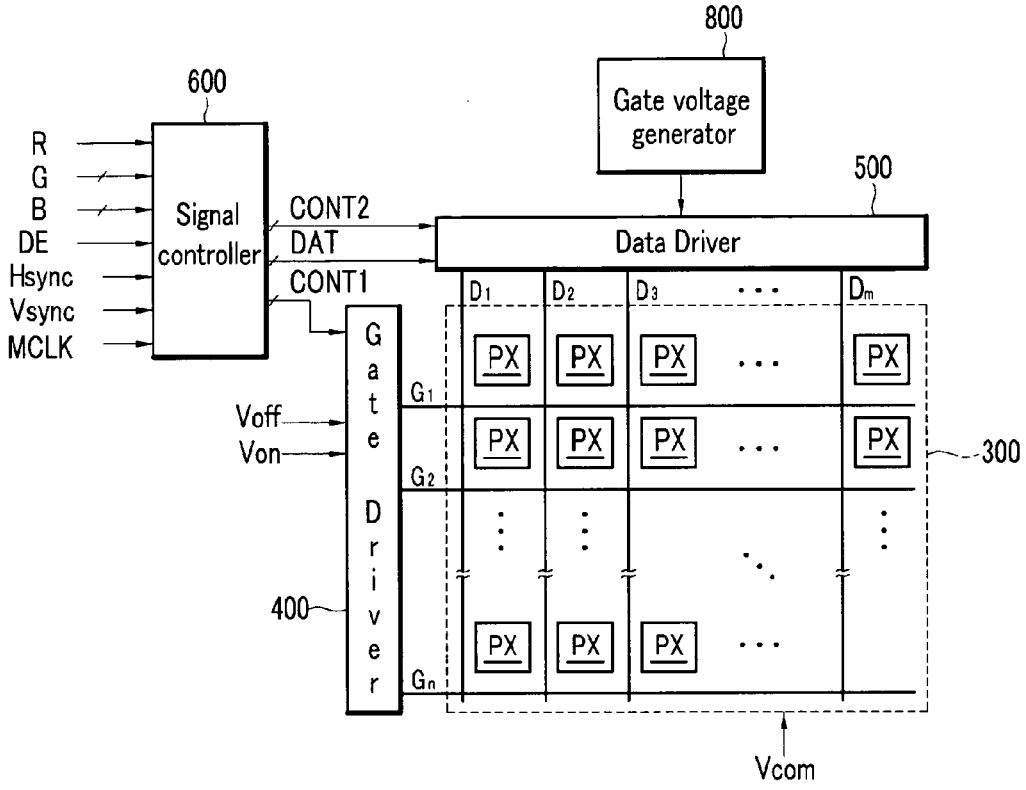
FIG. 1 is a block diagram of an LCD according to an embodiment of the present invention.

In the drawings, the thickness of layers and regions are exaggerated for clarity. Like numerals refer to like elements throughout. It will be understood that when an element such as a layer, film, region, substrate, or panel is referred to as being "on" another element, it can be directly on the other element or intervening elements may also be present. In contrast, when an element is referred to as being "directly on" another element, there are no intervening elements present.

Figure 2:
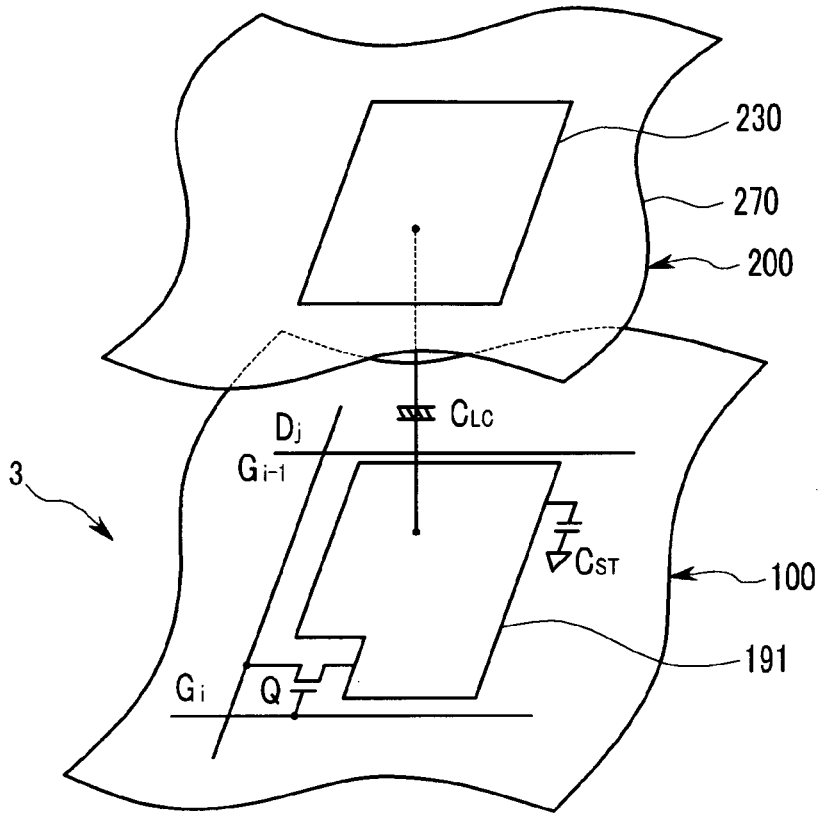
FIG. 2 is an equivalent circuit diagram of a pixel of an LCD according to an embodiment of the present invention.

Referring to FIG. 1, an LCD according to an embodiment of the present invention includes an LC panel assembly 300, and a gate driver 400 and a data driver 500 connected thereto, a gray voltage generator 800 connected to the data driver 500, and a signal controller 600 for controlling the above-described elements. The LC panel assembly 300, as shown in FIG. 2, includes a lower panel 100, an upper panel 200, and a liquid crystal layer 3 interposed therebetween, a plurality of signal lines $G_1$-$G_n$ and $D_1$-$D_m$, and a plurality of pixels PX connected thereto and arranged substantially in a matrix format in a circuital view shown in FIGS. 1 and 2.

The signal lines $G_1$-$G_n$ and $D_1$-$D_m$ are provided on the lower panel 100 and include a plurality of gate lines $G_1$-$G_n$ for transmitting gate signals (called scanning signals) and a plurality of data lines $D_1$-$D_m$ for transmitting data signals. The gate lines $G_1$-$G_n$ extend substantially in a row direction and are substantially parallel to each other, while data lines $D_1$-$D_m$ extend substantially in a column direction and are substantially parallel to each other. Each pixel PX, for example, a pixel PX connected to an i_th gate line $G_1$(i=1, 2, . . . , n) and a j_th data line $D_j$ (j=1, 2, . . . , m) includes a switching element Q connected to the display signal lines $G_1$-$G_n$ and $D_1$-$D_m$, and an LC capacitor $C_{LC}$ and a storage capacitor $C_{ST}$ that are connected to the switching element Q. The storage capacitor $C_{ST}$ may be omitted if it is unnecessary.

The switching element Q, such as a TFT, is provided on the lower panel 100 and has three terminals: a control terminal connected to one of gate lines $G_1$-$G_n$; an input terminal connected to one of the data lines $D_1$-$D_m$; and an output terminal connected to the LC capacitor $C_{LC}$ and the storage capacitor $C_{ST}$. The LC capacitor $C_{LC}$ includes a pixel electrode 191 provided on the lower panel 100 and a common electrode 270 provided on the upper panel 200, as two terminals. The LC layer 3 disposed between the two electrodes 191 and 270 functions as a dielectric of the LC capacitor $C_{LC}$. The pixel electrode 191 is connected to the switching element Q, and the common electrode 270 is supplied with a common voltage Vcom and covers an entire surface of the upper panel 200. Unlike in FIG. 2, the common electrode 270 may be provided on the lower panel 100, and both electrodes 191 and 270 may have shapes of bars or stripes.

The storage capacitor $C_{ST}$ is an auxiliary capacitor for the LC capacitor $C_{LC}$. The storage capacitor $C_{ST}$ includes the pixel electrode 191 and a separate signal line (not shown), which is provided on the lower panel 100, overlaps the pixel electrode 191 via an insulator, and is supplied with a predetermined voltage such as the common voltage Vcom. Alternatively, the storage capacitor $C_{ST}$ includes the pixel electrode 191 and an adjacent gate line called a previous gate line, which overlaps the pixel electrode 191 via an insulator.

For color display, each pixel PX uniquely represents one of primary colors (i.e., spatial division) or each pixel PX sequentially represents the primary colors in turn (i.e., temporal division), such that a spatial or temporal sum of the primary colors is recognized as a desired color. An example of a set of the primary colors includes red, green, and blue colors. FIG. 2 shows an example of the spatial division in which each pixel PX includes a color filter 230 representing one of the primary colors in an area of the upper panel 200 facing the pixel electrode 191. Alternatively, the color filter 230 is provided on or under the pixel electrode 191 on the lower panel 100. One or more polarizers (not shown) are attached to at least one of the panels 100 and 200.

Referring to FIG. 1 again, the gray voltage generator 800 generates two sets of gray voltages (or reference gray voltages) related to the transmittance of the pixels PX. The gray voltages in one set have a positive polarity with respect to the common voltage Vcom, while those in the other set have a negative polarity with respect to the common voltage Vcom.

The gate driver 400 is connected to gate lines $G_1$-$G_n$ of the panel assembly 300, and synthesizes the gate-on voltage Von and the gate-off voltage Voff from an external device to generate gate signals for application to gate lines $G_1$-$G_n$. The data driver 500 is connected to the data lines of the panel assembly 300 and applies data voltages, which are selected from the gray voltages supplied from the gray voltage generator 800, to the data lines $D_1$-$D_m$. However, the data driver 500 may generate gray voltages for all the grays by dividing the reference gray voltages and select the data voltages from the generated gray voltages when the gray voltage generator 800 generates reference gray voltages.

The signal controller controls the gate driver 400 and the data driver, etc. Each of the driving units 400, 500, 600, and 800 may include at least one integrated circuit (IC) chip mounted on the LC panel assembly 300 or on a flexible printed circuit (FPC) film as a tape carrier package (TCP) type, which are attached to the panel assembly 300. Alternately, at least one of the processing units 400, 500, 600, and 800 may be integrated with the panel assembly 300 along with the signal lines and the switching elements Q. As a further alternative, all the processing units 400, 500, 600, and 800 may be integrated into a single IC chip, but at least one of the processing units 400, 500, 600, and 800 or at least one circuit element in at least one of the processing units 400, 500, 600, and 800 may be disposed out of the single IC chip.

Now, the operation of the LCD will be described in detail. The signal controller 600 is supplied with input image signals R, G, and B and input control signals for controlling the display thereof from an external graphics controller (not shown). The input image signals R, G, and B contain luminance information of each pixel PX. The luminance has a predetermined number of gray levels, for example $1024(=2^{10})$, $256(=2^8)$, or $64(=2^6)$. The input control signals include a vertical synchronization signal Vsync, a horizontal synchronization signal Hsync, a main clock signal MCLK, a data enable signal DE, etc.

Signal controller 600 transmits gate control signals CONT1 to the gate driver 400 and the processed image signals DAT and data control signals CONT2 to data driver 500. The output image signals DAT are digital signals that have a predetermined number of values (or gray levels).

The gate control signals CONT1 include a scanning start signal STV for starting the gate-on voltage and at least one clock signal for controlling the output time of the gate-on voltage Von. The gate control signals CONT1 may further include an output enable signal OE for defining the duration of the gate-on voltage Von and a gate clock signal CPV for controlling the output time of the gate-on voltage Von.

The data control signals CONT2 include a horizontal synchronization start signal STH for controlling data transmission for a group of pixels PX, a load signal LOAD for controlling the application of the data voltages to the data lines $D_1$-$D_m$, and a data clock signal HCLK. The data control signal CONT2 may further include an inversion signal RVS for reversing the polarity of the data voltages (with respect to the common voltage Vcom).

In response to data control signals CONT2 from the signal controller 600, the data driver 500 receives a packet of the digital image data DAT for the group of pixels from the signal controller 600, converts the image data DAT into analog data voltages selected from the gray voltages supplied from the gray voltage generator 800, and applies the data voltages to the data lines $D_1$-$D_m$.

The gate driver 400 applies the gate-on voltage Von to gate line $G_1$-$G_n$ in response to gate control signals CONT1 from the signal controller 600, thereby turning on the switching elements Q connected thereto. The data voltages applied to data lines $D_1$-$D_m$ are supplied to the pixels PX through the activated switching elements Q.

The difference between the data voltage and the common voltage Vcom is presented as a voltage across the LC capacitor $C_{LC}$, which is referred to as a pixel voltage. The LC molecules in the LC capacitor $C_{LC}$ have orientations depending on the magnitude of the pixel voltage, and the molecular orientations determine the polarization of light passing through the LC layer 3. The polarizer(s) converts the light polarization into light transmittance such that the pixels PX display the luminance represented by the image data DAT.

This procedure is repeated during the horizontal period (which is denoted by "1H" and is equal to one period of the horizontal synchronization signal Hsync or the data enable signal DE), all gate lines $G_1$-$G_n$ are sequentially supplied with the gate-on voltage Von during a frame, thereby applying the data voltages to all pixels PX.

When the next frame starts after one frame finishes, the inversion control signal RVS applied to the data driver 500 is controlled such that the polarity of the data voltages is reversed (which is referred to as "frame inversion"). The inversion control signal RVS may also be controlled such that the polarities of the image data signals in one packet are reversed (for example, column inversion).

When voltages are applied to the LC capacitor $C_{LC}$, the pixel voltage, which has a magnitude based on the voltage difference across the LC capacitor $C_{LC}$, is charged. However, the applied data voltage applied by turning on the switching element Q of each pixel PX is limited, so it is hard to charge the LC capacitor $C_{LC}$ sufficiently. Furthermore, due to the slow response time of the LC molecules, an even longer charging time of the LC capacitor $C_{LC}$ becomes desirable. Thus, although the data voltage corresponding to desired luminance is applied to a pixel PX, the actual pixel voltage does not rapidly reach a target voltage due to the insufficient time for charging the LC capacitor $C_{LC}$, and therefore the desired luminance is not obtained. In particular, as the length of the data lines is increased, line resistance, signal delay time, etc., increase. Thereby, pixel electrode voltages that are applied to the pixel electrodes 191 of the pixels PX are lower than data voltages output from the data driver 500 for those pixels PX that are further from the data driver 500. The difference between the data voltages and the pixel electrode voltages causes a difference between the actual pixel voltages and the target pixel voltages to be further increased.

To compensating for the insufficient charging time, pixels PX in one row are pre-charged by data voltages (referred to as "pre-charging data voltages") corresponding to previous pixels PX of the previous pixel row, before charging (referred to as "main charging") by data voltages (referred to as "normal data voltages") corresponding to the particular pixels PX.

The operations of the LCD according to an embodiment of the present invention include an image signal modifying operation to modify the pixel voltage differences between pixels supplied with equal normal data voltages due to the difference between the pre-charged data voltages. The image signal modifying operation is carried out in the signal controller 600, but may be carried out in a separate image signal modifier.

Image signals (referred to as "present image signals $d_q$") with respect to pixels PX of any one pixel row q are modified based on the image signals (referred to as "previous image signals $d_{q-1}$") with respect to pixels PX of a previous pixel row q−1, to generate modified image signals $d_q'$. An inversion type of data voltages is a column inversion type in the LCD according to an embodiment of the present invention. An image signal modifier of the LCD according to an embodiment of the present invention will be described with reference to FIG. 3.

Figure 3:
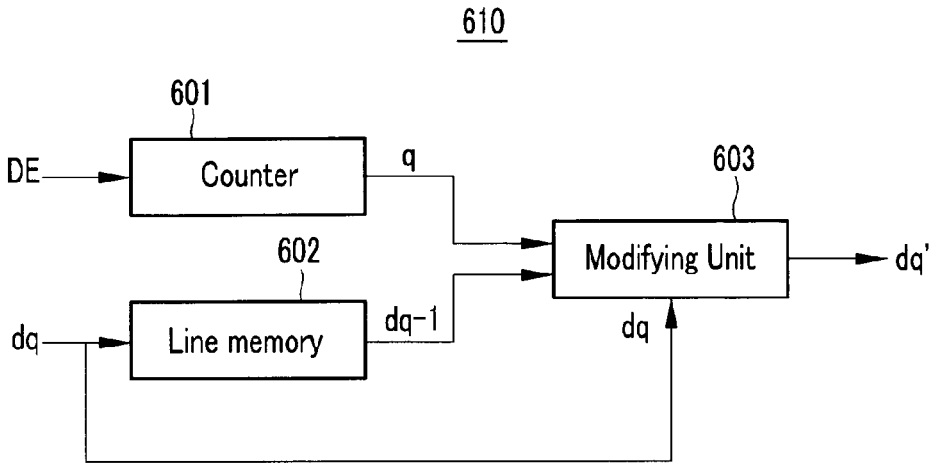
FIG. 3 is a block diagram of the image signal modifier of an LCD according to an embodiment of the present invention.

FIG. 3 is a block diagram of the image signal modifier of an LCD according to an embodiment of the present invention. Referring to FIG. 3, an image signal modifier 610 includes a counter 601, a line memory 602, and a modifying unit 603 connected to the counter 601 and the line memory 602. The counter 601 is supplied with a data enable signal DE and the line memory 602 is supplied with a present image signal $d_q$ corresponding to any one pixel row, for example, a q_th pixel row. The counter 601 counts the pulse number of the data enable signal DE, to output to the modifying unit 603 as a counted value q. That is, the counted value q denotes a pixel row number to which the present image signal $d_q$ belongs. Here, q=0, 1, 2, 3, . . . , n−1.

The line memory 602 stores the present image signal $d_q$ being applied and corresponding to the q_th pixel row and outputs a previous image signal $d_{q-1}$ corresponding to the (q−1)_th pixel row previously stored to the modifying unit 603. The image signal modifier 610 may be included in the signal controller 610 as shown in FIG. 1, but it may alternatively be implemented as a separate element. The modifying unit 603 modifies the present image signal $d_q$ based on the counted value q, the previous image signal $d_{q-1}$, and the present image signal $d_q$ to generate a modified image signal $d_q'$.

The operations of the image signal modifier 610 will now be described in detail. When the present image signal $d_q$ corresponding to the q_th pixel row is applied from an external device, the line memory 602 outputs the previous image data $d_{q-1}$ corresponding to the (q−1)_th pixel row and stores the present image signal $d_q$ in an address in which the previous image signal $d_{q-1}$ is stored. Thereby, the modifying unit 603 generates the modified image signal $d_q'$ based on the counted value q, the previous image signal $d_{q-1}$ from the line memory 602, and the present image signal $d_q$.

The operations of the modifying unit 603 will be described in detail below. The modifying unit 603 generates the modified image signal $d_q'$ using the following Equation 1.

$$d_q' = d_q + f(q, d_q, d_{q-1}) \quad \text{[Equation 1]}$$

As shown in Equation 1, the modified image signal $d_q'$ is generated by adding a value of a function f to the present image signal $d_q$, that is, an image signal of the q_th pixel row. The function f has relationships as below.

(1) if $d_q - d_{q-1} > 0$, $f(q, d_q, d_{q-1}) > 0$
(2) if $d_q - d_{q-1} < 0$, $f(q, d_q, d_{q-1}) < 0$
(3) if $d_q - d_{q-1} = 0$, $f(q, d_q, d_{q-1}) = 0$
(4) if q=0, $f(q, d_q, d_{q-1}) = 0$
(5) if r>q, $|f(r, d_r, d_{r-1})| \geq |f(q, d_q, d_{q-1})|$ That is, when a value of the previous image data $d_{q-1}$ is less than that of the present image signal $d_q$, the value of function f is larger than "0" and thereby a value of the modified image signal $d_q'$ becomes larger than that of the present image signal $d_q$. To the contrary, when a value of the previous image data $d_{q-1}$ is larger than that of the present image signal $d_q$, the value of function f is less than "0" and thereby a value of the modified image signal $d_q'$ becomes less than that of the present image signal $d_q$. Furthermore, when a value of the previous image data $d_{q-1}$ is equal to that of the present image signal $d_q$, a value of the modified image signal $d_q'$ becomes the present image signals $d_q$.

When the counted value q is "0", that is, the pixel row is the first pixel row, the present image signal $d_q$ becomes the modified image signal $d_q'$ since there is almost no negative influence due to the signal delay or line resistance by the data lines $D_1$-$D_m$. Also, as the counted value q become larger, that is, as the distance between the data driver 500 and the pixel row becomes larger, the function value f becomes larger and thereby a modified value added to the present image signal $d_q$ also becomes larger. Therefore, as the pixel row is increasingly subjected to the influence of the line resistance and the signal delay of the data lines $D_1$-$D_m$, the function value f increases. Thereby, the data voltage applied from the data driver 500 to each pixel PX is equal to, larger, or smaller than a data voltage corresponding to the present image signal $d_q$.

As another example, the modifying unit 603 generates a modified image signal $d_q'$ using Equation 2 that is more specific than Equation 1.

$$d_q'=d_q+\alpha(q)(d_q-d_{q-1}) \quad \text{[Equation 2]}$$

Here, $\alpha(0)=0$ and if $r>q$, $\alpha(r)>\alpha(q)$.

As shown in Equation 2, the modified image signal $d_q'$ is defined based on a modified value obtained by multiplying the difference between two image signals $d_q$ and $d_{q-1}$ by a value [$\alpha(q)$] that proportionally varies with respect to the counted value q. The modified image signal $d_q'$ obtained by the present and previous image signals $d_q$ and $d_{q-1}$ and the pixel row number q, that is, the counted value, using Equation 1 or Equation 2 may be stored in a separate look-up table as a function of the modified image signal $d_q'$ with respect to the present and previous image signals $d_q$ and $d_{q-1}$ and the counted value q.

Alternatively, instead of using Equation 1 or Equation 2, a modified image signal $d_q'$ with respect to the present and previous image signals $d_q$ and $d_{q-1}$ and the pixel row number q may be calculated by experiment considering a transmission curve of LC molecules, a transmission curve of LC molecules with respect to grays, the counted value q, etc. The calculated modified image signal $d_q'$ may be stored in a look-up table as a function with respect to the present and previous image signals $d_q$ and $d_{q-1}$ and the pixel row number q.

However, for storing all the modified image signals $d_q'$ with respect to the pixel row number q and the present and previous image signals $d_q$ and $d_{q-1}$ in the look-up table, the look-up table has to have a very large size. Therefore, modified image signals $d_q'$ with respect to present and previous image signals $d_q$ and $d_{q-1}$ by a predetermined gray interval, for example, a 16 gray interval, and the pixel row number q are stored in the look-up table, and then modified image signals with respect to the remaining present and previous image signals $d_q$ and $d_{q-1}$ and the pixel row number q are preferably calculated using interpolation.

When the modified image signal $d_q'$ with respect to the present image signal $d_q$ considering the pixel row number q and the previous image signal $d_{q-1}$ is calculated, the signal controller 600 applies the modified image signal $d_q'$ to the data driver 500 as image data DAT. Next, a display operation of an LCD according to an embodiment of the present invention 115 will be described in detail with reference to FIG. 4.

Figure 4:
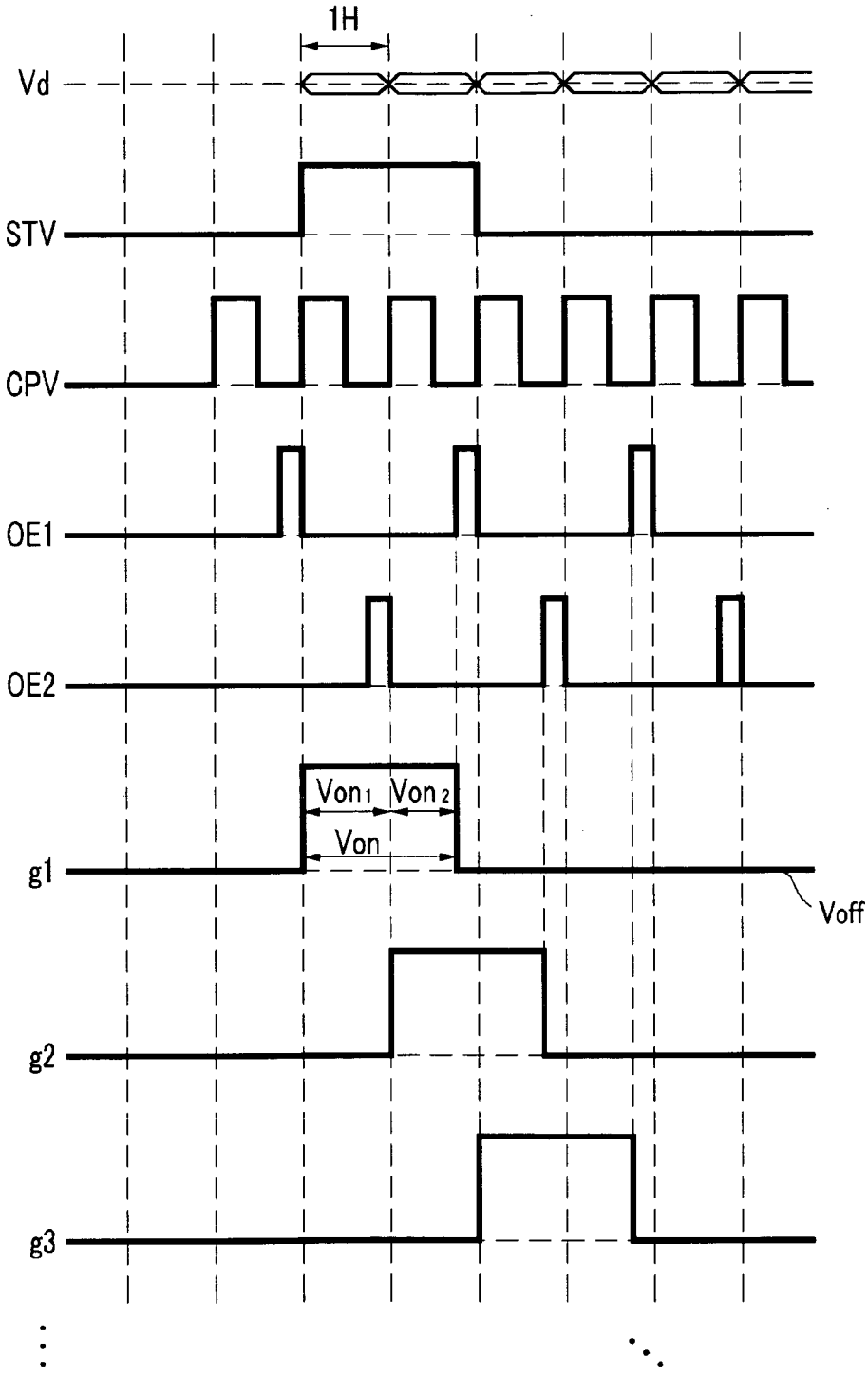
FIG. 4 illustrates waveforms of various signals used in an LCD according to an embodiment of the present invention.

FIG. 4 illustrates waveforms of various signals such as data voltages Vd, a scanning start signal STV, a gate clock signal CPV, output enable signals OE1 and OE2, and gate signals $g_1$, $g_2$, $g_3$, . . . used in an LCD according to an embodiment of the present invention. As described above, the signal controller 600 supplies the scanning start signal STV, the gate clock signal CPV, and the output enable signals OE1 and OE2 to the gate driver 400, to start the scanning of gate lines $G_1$-$G_n$.

Referring to FIG. 4, the gate-on voltage Von applied to one pixel row includes a pre-charging gate-on voltage Von1 and a main charging gate-on voltage Von2 sequential to the pre-charging gate-on voltage Von1. A pulse width of the pre-charging gate-on voltage Von1 is wider than that of the main charging gate-on voltage Von2 by about the pulse widths of the output enable signals OE1 and OE2. Thereby, a gate-on voltage Von does not overlap the next adjacent gate-on voltage such as a gate-on voltage applied by an even_th gate line or horizontal period. The pulse widths of the gate-on voltages Von1 and Von2 may each be varied. The pulse width of the pre-charging gate-on voltage Von1 is about 1H.

The scanning start signal STV includes a pulse for outputting the gate-on pulse Von. The output enable signals OE1 and OE2 are applied from the signal controller 600 to the gate driver 400 and function to define the duration, that is, a pulse width, of the gate-on voltage Von being transmitted though the corresponding gate lines $G_1$-$G_n$. In the embodiment of the present invention, the first output enable signal OE1 defines the duration of gate-on voltages Von applied to the odd_th gate lines $G_1$, $G_3$, . . . and the second output enable signal OE2 defines the duration of gate-on voltages Von applied to the even_th gate lines $G_2$, $G_4$, . . . . The output enable signals OE1 and OE2 have the same waveform as each other, but have different phases. However, waveforms of the output enable signals OE and OE may be varied or differ from each other. Referring to FIG. 4, when the output enable signals OE1 and OE2 have a high level, the output of the gate-on voltage Von is restricted, but when the output enable signals OE1 and OE2 have a low level, the output of the gate-on voltage Von occurs. The ratio of the interval of the high level and the interval of the low level may be adjusted based on a ratio of a pre-charging time and a main charging time, and the functions of the high level and the low level of the output enable signals OE1 and OE2 are reversed from each other.

Next, the operations of the pre-charging and the main charging will be described in detail. First, the signal controller 600 generates a pulse to the scanning start signal STV being applied to the gate driver 400 and generates a pulse to the gate clock signal CPV. The gate driver 400 supplied with the pulse of the scanning start signal STV sequentially outputs the gate-on voltage Von from the first gate line $G_1$ to the last gate line $G_n$. At this time, as shown in FIG. 4, since the two output enable signals OE1 and OE2 are applied to the gate driver 400, the pre-charging gate-on voltage Von1 and the main gate-on voltage Von2 are sequentially outputted. Thereby, the pulse width of the gate-on voltage Von applied to the odd_th gate lines $G_1$, $G_3$, . . . are defined by the output enable signal OE1, while the pulse width of the gate-on voltage Von applied to the even_th gate lines $G_2$, $G_4$, . . . are defined by the output enable signal OE2. Accordingly, the difference between an output time of the gate-on voltage Von applied to the odd_th gate lines $G_1$, $G_3$, . . . and an output time of the gate-on voltage Von applied to the even_th gate lines $G_2$, $G_4$, . . . is about "1H", which is the difference between output times of the output enable signals OE1 and OE2. That is, in two gate-on voltages Von applied to two immediately adjacent gate lines, an application time of a main charging gate-on voltage Von2 of the preceding gate-on voltage Von overlaps an application time of a pre-charging gate-on voltage Von1 of the following gate-on voltage Von.

By sequentially outputting of the gate-on voltages Von including a pre-charging gate-on voltage Von1 and a main charging gate-on voltage Von2, which have pulse widths defined by waveforms of the output enable signals OE1 and OE2, respectively, from the first gate line $G_1$ to the last gate line $G_n$, pixel electrodes 191 connected to the corresponding gate line from the first gate line $G_1$ are supplied with data voltages Vd transmitted through the data lines $D_1$-$D_m$, and thereby pixels PX connected to the pixel electrodes 191 are pre-charged for about "1H". After the finishing of the pre-charging, data voltages Vd corresponding to modified image signals generated by the above-described image signal modifier 610 are applied to the pixels PX as normal data voltages, and thereby the main charging of the pixels PX is carried out successively to the pre-charging. The data voltages applied to the first pixel row for the main charging may be stored as any data voltages Vd having predetermine gray levels in a memory, which is built into the signal controller 600.

As described above, the gate-on voltages Von applied to two adjacent gate lines have an overlapping period in which the main charging time of the previous pixel row connected to the previous gate line overlaps the pre-charging time of the following pixel row connected to the successive gate line. Thereby, since normal data voltages Vd applied to the pixel electrodes 191 connected to the first gate line $G_1$ for the main charging are applied to the pixel electrodes 191 connected to the second gate line $G_2$ at the same time, the pre-charging of the second pixel row is carried out for "1H."

When the pre-charging time of the second pixel row has elapsed, the pixel electrodes 191 connected to the second gate line $G_2$ are supplied with normal data voltages Vd from the data driver 500, and thereby the main charging of the second pixel row is carried out. By repeating the above procedures, when the gate-on voltages Von are sequentially applied to the first gate line $G_1$ to the last gate line $G_n$, all the pixels PX are pre-charged by the data voltages applied to the pixel electrode 191 connected to the previous gate line, and are then normally charged by data voltages corresponding to the modified image signals generated by the image signal modifier 610.

Figure 5:
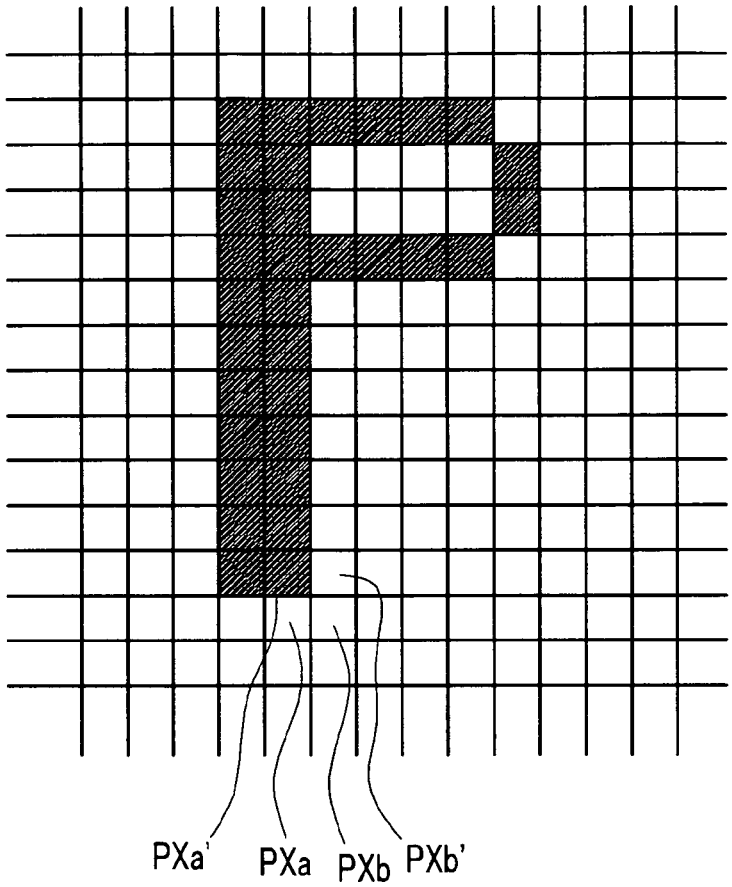
FIG. 5 is a diagram indicating a variation of pixel voltages of two adjacent pixels in the same pixel row, when a character "P" is displayed by a maximum gray and a minimum gray in an LCD according to an embodiment of the present invention.

The variation between a pixel voltage charged in a pixel by the pre-charging and the main charging according to the present invention and a pixel voltage charged in the pixel by the pre-charging and the main charging according to the prior art will now be described with reference to FIGS. 5 to 7. FIG. 5 is a diagram indicating a variation of pixel voltages of two adjacent pixels PXa and PXb in the same pixel row, when a character "P" is displayed by a maximum gray and a minimum gray in an LCD according to an embodiment of the present invention, FIG. 6 is a graph indicating a variation of a pixel electrode voltage and a pixel voltage when data voltages are applied to the two pixels PXa and PXb shown in FIG. 5, respectively, and FIG. 7 is a graph indicating a variation of a pixel electrode voltage and a pixel voltage when data voltages are applied to the two pixels PXa and PXb shown in FIG. 5 according to the prior art, respectively.

Referring to FIG. 5, the two pixels PXa and PXb are positioned in the same pixel row, for example, the r_th pixel row, and are supplied with data voltages (referred to as "white data voltages") corresponding to the same gray, for example, the maximum gray, that is, a white gray as normal data voltages for the main charging, when the LCD has a normally black mode.

Figure 6:
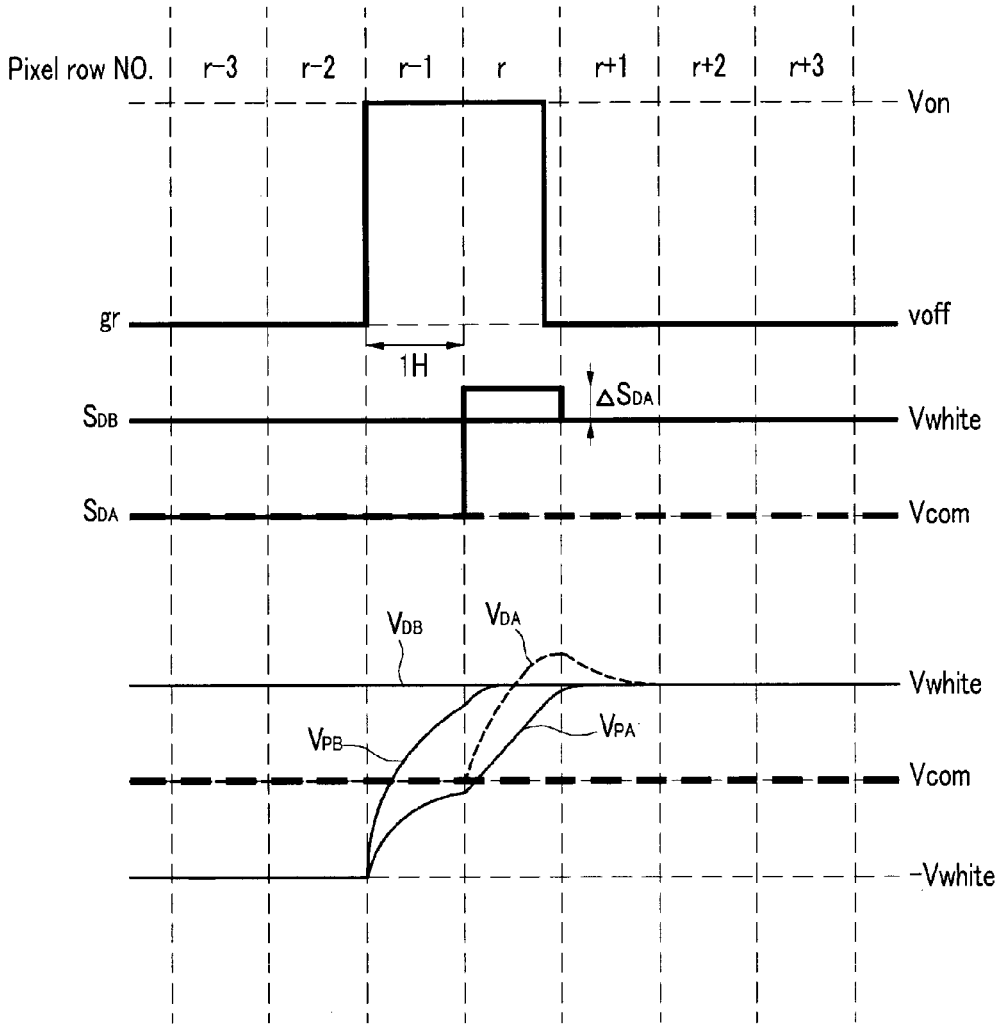
FIG. 6 is a graph indicating a variation of a pixel electrode voltage and a pixel voltage when data voltages are applied to the two pixels shown in FIG. 5, respectively.
Figure 7:
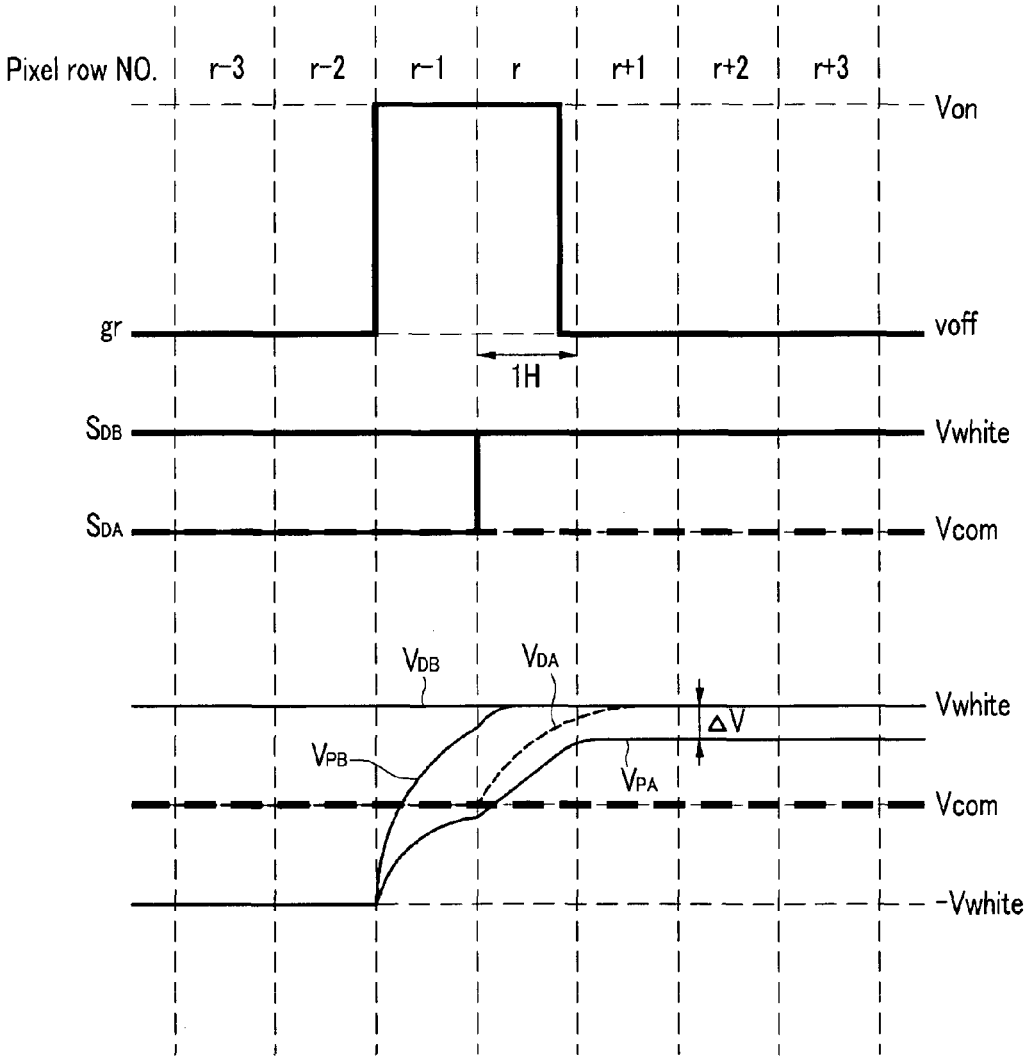
FIG. 7 is a graph indicating a variation of a pixel electrode voltage and a pixel voltage when data voltages are applied to the two pixels shown in FIG. 5 according to the prior art, respectively.

As shown in FIG. 6, a gate signal $g_r$ applied to the r_th gate line $G_r$ overlaps a gate voltage applied to the (r−1)_th gate line $G_{r-1}$ by "1H", and thereby a gate-on voltage applied to an (r−1)_th pixel row is applied to the r_th pixel row as well. As shown in FIGS. 5 and 6, a normal data voltage applied to a pixel PXa' of a previous (r−1)_th pixel row is a data voltage (referred to as "black data voltage) for displaying black, that is, the minimum gray. Thereby, a data voltage $S_{DA}$ applied to the pixel PXa is supplied with the black data voltage for a pre-charging time and is supplied with the white data voltage as a normal data voltage for a main charging time. At this time, a modified value is calculated of the present image signal based on the pixel row number, a present image signal, and a previous image signal by the operation of the image signal modifier as described. Thereby, the data voltage $S_{DA}$ applied for main charging of the pixel PXa has a magnitude that is a sum of a data voltage $\Delta S_{DA}$ corresponding to the modified value and the data voltage corresponding to the present image signal. However, as shown in FIGS. 5 and 6, a normal data voltage applied to a pixel PXb' of a previous (r−1)_th pixel row is the white data voltage. Thereby, a data voltage $S_{DB}$ applied to the pixel PXb is supplied with the white data voltage for the pre-charging time and the main charging time.

As the data voltages $S_{DA}$ and $S_{DB}$ are transmitted through the corresponding data lines, respectively, the data voltages $S_{DA}$ and $S_{DB}$ are applied to the corresponding pixels PXa and PXb as pixel electrode voltages $V_{DA}$ and $V_{DB}$, respectively, after a delay due to parasitic capacitance formed between the data lines and pixel electrodes or line delay of a predetermined time. However, as shown in FIG. 6, since the pixel electrode voltage $V_{DB}$ applied to the pixel PXb is equal to the data voltage of the previous pixel row, almost no signal delay occurs.

By application of the pixel electrode voltage $V_{DA}$ and $V_{DB}$, pixel voltages $V_{PA}$ and $V_{PB}$ charged in the pixels PXa and PXb, respectively, are shown in FIG. 6. As shown in FIG. 6, since the data voltages $S_{DA}$ and $S_{DB}$ applied for the pre-charging time of the pixels PXa and PXb are different from each other, magnitudes of the pixel voltages $V_{PA}$ and $V_{PB}$ charged for the pre-charging time are different from each other. However, since by the modification of the data voltage $S_{DA}$ for the pixel PXa the data voltage $S_{DA}$ increases by the modified value $\Delta S_{DA}$ and is applied to the pixel PXa, the magnitude difference between the pixel voltages $V_{PA}$ and $V_{PB}$ occurring for the pre-charging time is compensated, and thereby the magnitudes of the two pixel voltages $V_{PA}$ and $V_{PB}$ substantially become equal to each other. Accordingly, the luminance difference of the two pixels PXa and PXb due to the difference of the pixel voltages $V_{PA}$ and $V_{PB}$ in pre-charging does not occur.

Although the two pixel voltages $V_{PA}$ and $V_{PB}$ are not equal to each other, when a user sees an object, the user recognizes edge portions (or boundary portions) as brighter than other portions. Thereby, the pixels PXa, and PXb, which are disposed in the boundary of a portion displaying black and a portion displaying white have a small luminance difference therebetween, but the luminance difference is largely not recognized. However, when the data voltages $S_{DA}$ and $S_{DB}$ are applied to the pixels PXa and PXb shown in FIG. 5 according to the prior art, the difference between the pixel voltages $V_{PA}$ and $V_{PB}$ occurring for the pre-charging time of the pixels PXa and PXb is not compensated, and does not have the data voltage $\Delta S_{DA}$ corresponding to the modified value added to the data voltage $S_{DA}$ applied to the pixel PXa. Therefore, a voltage difference $\Delta V$ generates based on a voltage difference $\Delta S_{DA}$ between the pixel electrode voltages $V_{PA}$ and $V_{PB}$, and thereby it is hard for the pixel voltage $V_{PB}$ to reach a desired voltage $V_{white}$ for the main charging time. The voltage difference $\Delta V$ causes the luminance difference between the pixels PXa and PXb to deteriorate image quality.

Figure 8:
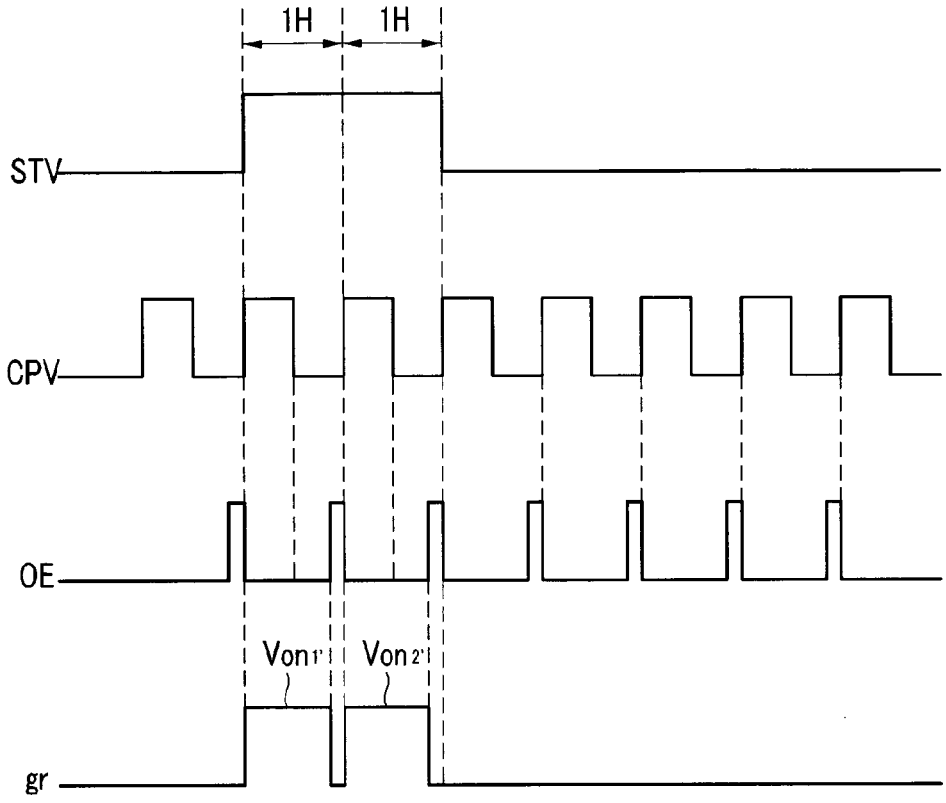
FIG. 8 illustrates waveforms of various signals used in an LCD for generating gate signals according to another embodiment of the present invention.

A method of generating gate signals according to another embodiment of the present invention will now be described with reference to FIG. 8. FIG. 8 illustrates waveforms of various signals such as a scanning start signal STV, a gate clock signal CPV, an output enable signal OE, and a gate signal $g_r$ applied to the r_th pixel row used in an LCD for generating gate signals according to another embodiment of the present invention. Referring to FIG. 8, the number of the output enable signals is one. Differently from the gate signals shown in FIG. 4, the gate signal $g_r$ shown in FIG. 8 does not successively generate a gate-on voltage Von1' for pre-charging and a gate-on voltage Von2' for main charging. The gate-on voltage Von1' and the gate-on voltage Von2' are generated by the output enable signal OE for a pre-charging time and a main charging time, respectively.

According to the present invention, by making two gate-on voltages applied to two adjacent gate lines overlap each other for a predetermined time, the total application time of a gate-on voltage to pixels increases, to increase a charging time of each pixel. Furthermore, a pixel is pre-charged by a data voltage applied to an adjacent pixel immediately adjacent thereto, which has a similar magnitude to that of the pixel, to easily reach a voltage having a desired magnitude. In the same pixel row, a normal data voltage is compensated considering the pre-charged data voltage and the compensated normal data voltage is applied to a pixel. Thereby, luminance differences between pixels disposed in the same pixel row that are main-charged with the same normal data voltages, which causes pre-charged voltages that are different from each other to decrease, to improve image quality. In particular, since the modification of the normal data voltage is carried out considering the pixel row number, image deterioration due to line resistance of data lines and signal delay decreases.

While the present invention has been described in detail with reference to the preferred embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a first pixel disposed on a first pixel row and a second pixel disposed on a second pixel row adjacent to the first pixel row and adjacent to the first pixel in a column direction;

a first gate line for transmitting a first gate-on voltage to the first pixel;

a second gate line for transmitting a second gate-on voltage to the second pixel;

a data line for transmitting first and second data voltages to the first and second pixels, respectively, and;

an image signal modifier for modifying a second input image signal based on a first input image signal for the first pixel, the second input image signal for the second pixel and a pixel row number of the second pixel to generate a modified image signal;

a gate driver for applying the first and second gate-on voltages to the first and second gate lines, respectively; and a data driver for changing the first input image signal and the modified image signal into the first and second data voltages to apply to the data line, respectively, wherein the first gate-on voltage overlaps the second gate-on voltage for a predetermined time to pre-charge the second pixel with the first data voltage of the first pixel, wherein the image signal modifier comprises a counter for counting the pixel row number of the second pixel to output a counted value and modifying the second input image signal based on the counted value, and wherein the image signal modifier calculates the modified image signal dq' using $dq'=dq+f(q, dq, dq-1)$ (where dq is the second input image signal, q is the counted value, and dq−1 is the first input image signal), wherein, if $dq-dq-1>0$, $f(q, dq, dq-1)>0$, if $dq-dq-1<0$, $f(q, dq, dq-1)<0$, if $dq-dq-1=0$, $f(q, dq, dq-1)=0$, if $q=0$, $f(q, dq, dq-1)=0$, and if $r>q$, $|f(r, dr, dr-1)|\geq|f(q, dq, dq-1)|$.

2. The device of claim 1, wherein the counter outputs the counted value based on a data enable signal from an external device.

3. The device of claim 1, wherein the image signal modifier modifies the second image signal based on a difference between the first input image signal and the second input image signal.

4. The device of claim 1, wherein the first and second gate-on voltages comprise a pre-charging gate-on voltage and a main charging gate-on voltage successively being generated to the pre-charging gate-on voltage, respectively, and the main pre-charging gate-on voltage of the first gate-on voltage overlaps the pre-charging gate-on voltage of the second gate-on voltage.

5. The device of claim 4, further comprising a signal controller for controlling the gate driver and the data driver, and the signal controller applies a scanning start signal STV for instructing to start outputting of the first and second gate-on voltages and an output enable signal for defining the duration of the first and second gate-on voltage, respectively, to the gate driver.

6. The device of claim 5, wherein the output enable signal has a pulse output period of 1H.

7. The device of claim 5, wherein the output enable signal has a first output enable signal for defining the duration of the first gate-on voltage and a second output enable signal for defining the duration of the second gate-on voltage.

8. The device of claim 7, wherein the first and second output enable signals have a pulse output period of 2H.

9. The device of claim 8, wherein the first and second output enable signals output a pulse at a 1H interval, in turn.

10. The device of claim 1, wherein the image signal modifier comprises a line memory for storing the first input image signal.

11. The device of claim 1, wherein the image signal modifier comprises a look-up table for storing the modified image signal.

12. The device of claim 1, wherein polarities of a first data voltage corresponding to the first input image signal and a second data voltage corresponding to the second input image signal are equal to each other.

13. The device of claim 12, wherein the display device is a column inversion type of display device.

14. A display device comprising:

a first pixel disposed on a first pixel row and a second pixel disposed on a second pixel row adjacent to the first pixel row and adjacent to the first pixel in a column direction;

a first gate line for transmitting a first gate-on voltage to the first pixel;

a second gate line for transmitting a second gate-on voltage to the second pixel;

a data line for transmitting first and second data voltages to the first and second pixels, respectively, and an image signal modifier for modifying a second input image signal based on a first input image signal for the first pixel, the second input image signal for the second pixel and a pixel row number of the second pixel to generate a modified image signal;

a gate driver for applying the first and second gate-on voltages to the first and second gate lines, respectively; and a data driver for changing the first input image signal and the modified image signal into the first and second data voltages to apply to the data line, respectively, wherein the first gate-on voltage overlaps the second gate-on voltage for a predetermined time to pre-charge the second pixel with the first data voltage of the first pixel, wherein the image signal modifier comprises a counter for counting the pixel row number of the second pixel to output a counted value and modifying the second input image signal based on the counted value, and wherein the image signal modifier calculates the modified image signal $d_q'$ using $d_q'=d_q+\alpha(q)(d_q-d_{q-1})$ (where dq is the second input image signal, q is the counted value, and dq−1 is the first input image signal), wherein $\alpha(0)=0$ and if $r>q$, $\alpha(r)>\alpha(q)$.

15. A driving method of a display device having a first pixel disposed on a first pixel row and a second pixel disposed on a second pixel row adjacent to the first pixel row and adjacent to the first pixel in a column direction;

a first gate line for transmitting a first gate-on voltage to the first pixel, a second gate line for transmitting a second gate-on voltage to the second pixel, and a data line for transmitting first and second data voltages to the first and second pixels, respectively;

an image signal modifier for modifying a second input image signal based on a first input image signal for the first pixel, the second input image signal for the second pixel and a pixel row number of the second pixel to generate a modified image signal;

a gate driver for applying the first and second gate-on voltages to the first and second gate lines, respectively; and a data driver for changing the first input image signal and the modified image signal into the first and second data voltages to apply to the data line, respectively, the method comprising applying the first gate-on voltage to the first gate line, applying the first data voltage to the first pixel, applying the second gate-on voltage to the second gate line, applying the first data voltage to the second pixel to pre-charge the second pixel with the first data voltage, stopping application of the first gate-on voltage, applying the second data voltage to the second pixel, and stopping application of the second gate-on voltage, wherein the first gate-on voltage overlaps the second gate-on voltage for a predetermined time, wherein the image signal modifier comprises a counter for counting the pixel row number of the second pixel to output a counted value and modifying the second input image signal based on the counted value, and wherein the image signal modifier calculates the modified image signal dq' using $dq'=dq+f(q, dq, dq-1)$ (where dq is the second input image signal, q is the counted value, and $dq-1$ is the first input image signal), wherein, if $dq-dq-1>0$, $f(q, dq, dq-1)>0$, if $dq-dq-1<0$, $f(q, dq, dq-1)<0$, if $dq-dq-1=0$, $f(q, dq, dq-1)=0$, if $q=0$, $f(q, dq, dq-1)=0$, and if $r>q$, $|f(r, dr, dr-1)|\geq|f(q, dq, dq-1)|$.

16. The method of claim 15, wherein the first and second gate-on voltages comprise a pre-charging gate-on voltage and a main charging gate-on voltage, respectively.

17. The method of claim 16, wherein the first data voltage is applied to the first and second pixels after application of the main charging gate-on voltage of the first gate-on voltage and the pre-charging gate-on voltage of the second gate-on voltage, and the second data voltage is applied to the second pixels after application of the main charging gate-on voltage of the second gate-on voltage.

18. The method of claim 17, wherein the pre-charging gate-on voltage of the first gate-on voltage overlaps the main charging gate-on voltage of the second gate-on voltage for a predetermined time.

19. The method of claim 15, wherein the display device is of a column inversion type.

* * * * *